US005579788A

United States Patent [19]

Ammermann et al.

[11] Patent Number: 5,579,788

[45] Date of Patent: Dec. 3, 1996

[54] APPARATUS FOR THE SURFACE TREATMENT OF MATERIAL TO BE TREATED BY MEANS OF A TREATMENT LIQUID, IN PARTICULAR A BAND PICKLING PLANT

[75] Inventors: Walter Ammermann, Bochum; Helmut Jung, Hagen; Jurgen Jaschinski, Unna; Udo Riedesel, Hemer, all of Germany

[73] Assignee: Sundwiger Eisenhutte Maschinenfabrik GmbH & Co., Hemer, Germany

[21] Appl. No.: 518,461

[22] Filed: Aug. 23, 1995

[30] Foreign Application Priority Data

Aug. 30, 1994 [DE] Germany ..... 44 30 567.2

[51] Int. Cl.[6] ..... B08B 3/02

[52] U.S. Cl. ..... 134/64 R; 134/83; 134/133; 134/122 R; 134/199

[58] Field of Search ..... 134/64 R, 122 R, 134/200, 199, 83, 133

[56] References Cited

U.S. PATENT DOCUMENTS

| | | | |
|---|---|---|---|
| 2,216,544 | 10/1940 | True et al. | 134/64 R |
| 2,525,203 | 10/1950 | Bostroem | 134/122 R |
| 3,032,890 | 5/1962 | Brick et al. | 134/122 R |
| 3,625,232 | 12/1971 | Hilden et al. | 134/122 R |
| 3,803,996 | 4/1974 | Marshall | 134/64 R |
| 4,007,750 | 2/1977 | Galloway | 134/83 |
| 5,205,303 | 4/1993 | Gileta | 134/122 X |
| 5,248,372 | 9/1993 | McNamee | 134/122 X |

FOREIGN PATENT DOCUMENTS

| | | | |
|---|---|---|---|
| 0058216 | 8/1982 | European Pat. Off. . | |
| 1040347 | 10/1953 | France . | |
| 1112682 | 10/1960 | Germany | 134/122 |
| 1546204 | 5/1969 | Germany | 134/122 |
| 2111084 | 6/1983 | United Kingdom | 134/127 R |
| 2117006 | 10/1983 | United Kingdom . | |

*Primary Examiner*—Frankie L. Stinson
*Attorney, Agent, or Firm*—Meltzer, Lippe, Goldstein, et al.

[57] ABSTRACT

In an apparatus for the surface treatment of material to be treated by means of a treatment liquid, in particular a band pickling plant, with a vessel (1) receiving the treatment liquid (F), through which the material (S) to be treated can be conveyed, with a lid (2) with which the vessel (1) can be tightly sealed, with an inlet and outlet opening (4, 5) through which the material (S) to be treated enters into and exits from the vessel (1), and with suction openings (9*a*, 11*a*) through which the evaporated treatment liquid (F) can be sucked off from the vessel (1), the quantity of the gas to be discharged is reduced in accordance with the invention and, simultaneously, the danger of damaging the material (S) to be treated is reduced without impairing the performance of the apparatus in such a way that in the zone of the inlet and outlet opening (4, 5) of the vessel (1) one inlet chamber and one outlet chamber (9, 11) are separated from the inner space (8) of the vessel (1) by at least one shut-off partition (7, 10) each extending between the side walls of the vessel (1) and, when the lid (2) is closed, from the same to at least the surface of the treatment liquid (F) and that the inlet and outlet chambers (9, 11) are each provided with at least one suction opening (9*a*, 11*a*) for the evaporated treatment liquid (F).

12 Claims, 2 Drawing Sheets

APPARATUS FOR THE SURFACE TREATMENT OF MATERIAL TO BE TREATED BY MEANS OF A TREATMENT LIQUID, IN PARTICULAR A BAND PICKLING PLANT

The invention relates to an apparatus for the surface treatment of material to be treated by means of a treatment liquid, in particular a band pickling plant, with a vessel receiving the treatment liquid through which the material to be treated can be conveyed, with a lid with which the vessel can be tightly closed, with an inlet and outlet opening through which the material to be treated enters into and exits from the vessel, and with suction openings through which the evaporated treatment liquid can be sucked off from the vessel.

Steel bands for example are surface-treated in a continuous process in apparatuses of the kind mentioned above by being pulled through vessels filled with the treatment liquid. The vessel is not fully filled, but a free space remains above the liquid level. The gases arising during the heating of the treatment liquid collect in said free space. These gases are usually aggressive and therefore must be removed in order to prevent any uncontrolled escape of the gases from the apparatus.

The discharge of said gases usually causes considerable problems in the disposal of the acids usually contained therein. On the other hand, very large quantities of heat are removed from the treating apparatus simultaneously with the gases. This leads to a considerable consumption of energy for heating the treatment liquid.

In an apparatus of the kind mentioned above as known from the European Patent Application EP 0 058 216 A1 displacement bodies are provided for reducing the free vessel volume and for reducing the heat requirements. Said bodies immerse into the treatment liquid during the treatment of the material to be treated. As a result of the large-area displacement bodies the evaporation surface of the liquid is considerably reduced so that relatively little gas needs to be carried off during the treatment process. This advantage in known apparatuses is contrasted in that the installation of such displacement bodies limits the accessibility to the treatment liquid after the opening of the vessel. Simultaneously, frequent contacts occur between the material and the displacement bodies, particularly under high conveying speeds of the material to be treated. As a result of this the displacement bodies and the surface of the material to be treated are damaged. This danger also exists in the apparatus known from the patent application DE 36 29 894 C2. The treatment level is upwardly limited in this application by intermediate lids.

It is the object of the present invention to improve an apparatus of the kind mentioned above in such a way that the quantity of the gas to be discharged is reduced and simultaneously the danger of damage to the material to be treated is reduced without impairing the performance of the apparatus.

This object is achieved in accordance with the invention in that in the zone of the inlet and outlet opening of the vessel one inlet chamber and one outlet chamber are separated from the inner space of the vessel by at least one shut-off partition each extending between the side walls of the vessels and, when the lid is closed, from the same to at least the surface of the treatment liquid and that the inlet and outlet chambers are each provided with at least one suction opening for evaporated treatment liquid.

In accordance with the invention, a substantially enclosed inner space is separated from an inlet and outlet chamber by respectively arranged shut-off partitions. The volume of the inner space is larger by several times than the volume of the two chambers. As the inner space is enclosed substantially gas-tight, it is only necessary to carry off the gas volume in the apparatus in accordance with the invention which arises by evaporation of the treatment liquid in the zone of the inlet and outlet chambers. The separation of the inner space leads to the additional effect that a rise in pressure occurs in case of an increase in the formation of gas in the inner space of the vessel. If this rise in pressure reaches a certain level then the further formation of vapour is reduced.

As a result of the reduced gas volume to be discharged, the heat losses connected with the discharge of the gas are also reduced to a minimum. The ventilation of the respective inlet and outlet chamber can be omitted entirely when several apparatuses in accordance with the invention are arranged successively in a row behind one another. In this case it is only necessary to discharge the gas from the first inlet chamber and the last outlet chamber.

In accordance with the invention the surface of the treatment liquid remains uncovered over the major part of the length of the vessel, so that the danger of damaging the material to be treated is reduced to a minimum during the treatment. The liquid level within the inner space can be changed easily by a respective selection of the immersion depth of the partitions into the treatment liquid. In this way it is also possible to control in a specific manner the volume flow exiting from the vessel and thus also the exchange of the treatment liquid. In addition, the maintenance of the apparatus in accordance with the invention is not impaired after the opening of the vessel by any cover elements attached to the lid, immersed in the treatment liquid or resting on the edge of the vessel.

The danger of damaging the surface of the material to be treated can be prevented additionally in that each shut-off partition is provided with a floating body resting on the surface of the liquid. As a result of such a floating body it is possible to seal the inner space of the vessel against the inlet and outlet chamber with a minimal immersion depth. In this respect it is favourable in many cases when the floating bodies are held vertically displaceably, as in this way they are allowed to follow fluctuations in the level of the treatment liquid.

In other applications it may be beneficial when the immersion depth of the floating body is changeable, with the change in the immersion depth being achieved in such a way, for example, that the weight of the floating body is changed by filling with water or a similar medium.

In both applications as explained above it is beneficial if the floating body is arranged in the shape of a roller. Such a rotatable roller body is made to rotate on contact between the material to be treated and the shut-off partition, so that any damage to the surface of the material is prevented.

It is also beneficial if each shut-off partition is swivellable about an axis which is arranged transversally to the direction of movement of the material to be treated. As a result of such a swivellable bearing of the shut-off partitions they can give way, for example, to the initial part of the material by pivoting out during the introduction of new material to be treated. Elastic means should extert a retaining force on the shut-off partitions, moving them to their usual position in order to ensure that the shut-off partitions maintain their usual position during the operation and are not pivoted away, for example, by the rise in the pressure or by treatment liquid flowing out of the vessel.

It is also preferable if a seal is arranged between the lid and each shut-off partition. Such a seal improves the separation between the inner space of the vessel and the inlet and outlet chamber. The sealing elements per se may be arranged as elastic means retaining the shut-off partitions. It is particularly favourable in this respect if the elasticity of the seals is changeable, because in this way the retaining or sealing effect of the sealing elements can be adjusted to the respective operating conditions.

The volume flow exiting from the vessel can be easily optimized in such a way that a wearing stone is arranged on the floor of the vessel in the zone of the shut-off partitions which extends over the width of the vessel and that said wearing stone is provided with an outlet opening for the treatment liquid.

The pressure conditions in the separated inner space of the vessel can thus be changed, so that the evaporated treatment liquid can be discharged from the inner space via a closable throttle valve. Such a valve allows discharging certain undesirable gases from the inner space in a purposeful manner.

In cases where pairs of squeezing rollers for removing the treatment liquid from the material to be treated in the zone of the inlet and outlet opening are necessary it is beneficial to arrange the said rollers within the respective chambers, because in this way it is possible to exclude any uncontrolled escape of gas in the bearing zone. This is particularly advantageous when the squeezing rollers are arranged within a plurality of apparatuses in accordance with the invention which are arranged in a row.

The invention is now explained below in closer detail by reference to the enclosed drawing representing an embodiment, wherein.

Figure 1:
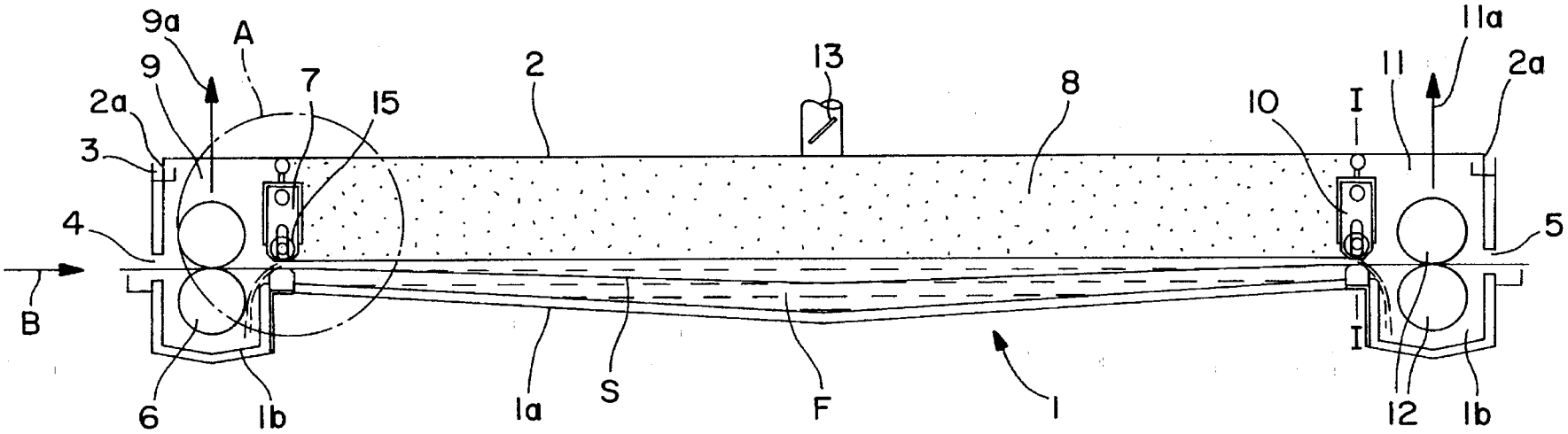
FIG. 1 shows a band pickling plant in a longitudinal section.
Figure 3:
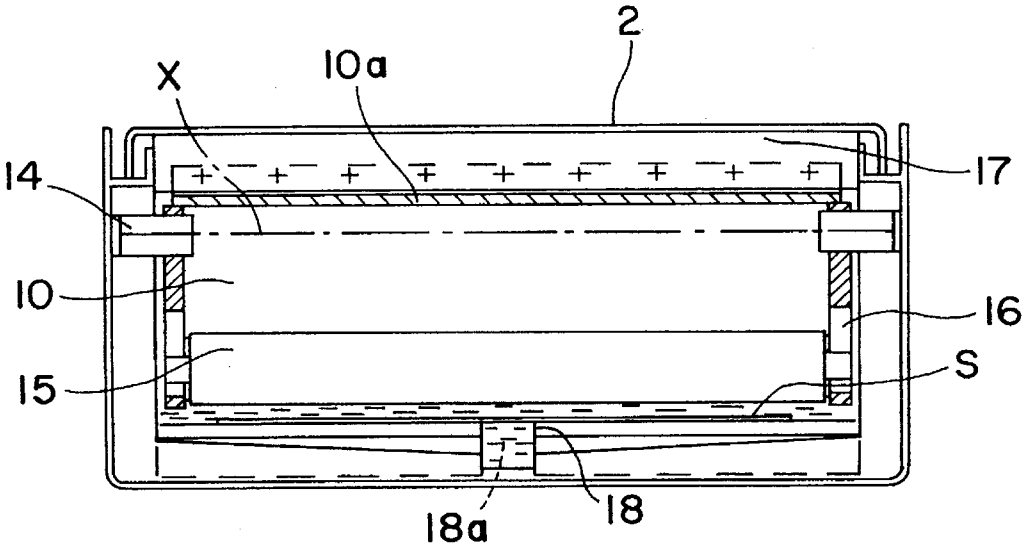
FIG. 3 shows the band pickling plant in accordance with FIG. 1 in a cross section along the lines of intersection I—I of FIG. 1.
Figure 2:
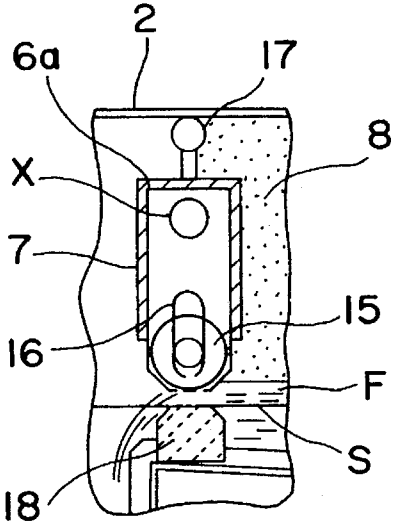
FIG. 2 shows a section A of FIG. 1 on an enlarged scale.

The band pickling plant in accordance with FIG. 1 is provided with a vessel 1 which is enclosed by a thickwalled lid 2. With its edges 2*a* the lid 2 sits in a water seal 3 which seals it. The floor la of the vessel 1 is provided with a depression in its central region. Moreover, collecting trays 1*b* are provided in the zone of the inlet opening 4 and the outlet opening 5 of vessel 1, into which the pickling liquid F flows from the central zone of vessel 1. The pickling liquid F is supplied from said collecting trays 1*b* to a preparation plant (not shown).

In the zone of inlet opening 4 a first pair of squeezing rollers 6 is arranged within the vessel 1. A first shut-off partition 7 is provided downstream of said pair of squeezing rollers 6 in the direction of the band conveyance B of the steel band S to be treated in the pickling plant. Said shut-off partition separates an inlet chamber 9 from the inner space 8 of the vessel in the region of the inlet opening 4.

A second shut-off partition 10 is provided downstream at a considerable distance from the first shut-off partition 7 in the direction of the course of the band B of the steel band S. The shut-off partition 10 is allocated to the outlet opening 5 of the vessel 1 and separates an outlet chamber 11 from the inner space of vessel 1. A second pair of squeezing rollers 12 is arranged in the outlet chamber 11, by means of which the treatment liquid F attached to the steel band S is squeezed off prior to the exit of the steel band S from the pickling plant. The inner space 8 of vessel 1 is connected to a gas-suction unit via a throttle valve 13. The inlet chamber 9 and the outlet chamber 11 are also connected thereto via outlet openings 9*a*, 11*a*.

The shut-off partitions 7, 10 are held swivellably about a pivoting axis X on pivot pins 14 and will give way and avoid any damage by pivoting about said axis X when the band S pushes against it in case that a crack in the band occurs, a new band S is inserted or any other defect arises in the band S.

The shut-off partitions 7, 10 are each provided with a rotatably held floating roll 15 which can be filled with water to change the weight. The floating roll 15 is held laterally height-adjustable in vertically aligned groove-like slots 16, so that the floating roll 15 can follow any changes in the liquid level of the pickling liquid F. A sealing element 17 is each arranged between the upper sides 6*a*, 10*a* of the shut-off partitions 7, 10 and the liquid 2, which element is loaded after the placement of the lid 2 on vessel 1 in such a way that it exerts an elastic retaining force on the respective shut-off partition.

Wearing stones 18 are arranged below the shut-off partitions 7, 10 which prevent that the steel band S touches the floor 1*a* of the vessel in the region of the inlet and outlet openings 4,5 of the vessel 1. The wearing stones 18 are provided with outlet openings 18*a* which are arranged in the centre, through which a fixedly predetermined volume stream of pickling liquid F flows from the inner space 8 into the collecting tray 1*b*.

During the operation of the pickling plant as explained above, the pressure in the inner space 8 rises by the evaporating pickling liquid F with respect to the pressure prevailing in the inlet and outlet chambers 9, 11. When this pressure reaches a certain value, the formation of vapour within the inner space 8 decreases.

The pressure conditions in the inner space 8 of the vessel are adjustable by the throttle valve 13. The low gas volume which is formed in the zone of the inlet and outlet chambers 9, 11 by the evaporating pickling liquid F flowing from the inner space 8 is discharged by the suction unit (not shown).

List of reference numerals:

1 Vessel
1*a* Vessel floor
1*b* Collecting tray
2 Lid
3 Water seal
4 Inlet opening
5 Outlet opening
6 Pair of squeezing rollers
6*a* Upper side of shut-off partition 7
7 Shut-off partition
8 Inner space
9 Inlet chamber
9*a* Outlet opening
10 Shut-off partition
10*a* Upper side of shut-off partition 10
11 Outlet chamber
11*a* Outlet opening
12 Pair of squeezing rollers
13 Throttle valve
14 Pivot pin
15 Floating roll
16 Slots
17 Sealing element
18 Wearing stone F Treatment liquid S Steel band X Swivelling axis

We claim:

1. Apparatus for the surface treatment of material with a treatment liquid, comprising a vessel through which said materials to be treated is to be conveyed, said vessel having sidewalls, a bottom, a closable lid, and an inner space, an inlet opening and an outlet opening in said vessel through which said material to be treated is introduced into and exits from said vessel, at least a first shut-off partition in the region of said inlet opening and at least a second shut-off partition in the region of said outlet opening, said first and second shut-off partitions extending between opposing sidewalls and from said lid when it is closed to at least the surface of said treatment liquid, said first and second shut-off partitions defining an inlet chamber and an outlet chamber which are separated from said inner space, and at least one suction opening located in said inlet chamber and at least one suction opening located in said outlet chamber through which said treatment liquid can be suctioned off, wherein each of said first and second shut-off partitions includes a floating body which rests on the surface of said treatment liquid.

2. The apparatus of claim 1 wherein said floating body comprises a height adjustable floating body.

3. The apparatus of claim 2 wherein said floating body is immersed into said treatment liquid up to an immersion depth, and wherein said immersion depth is adjustable.

4. The apparatus of claim 1 wherein said floating body comprises a floating roll.

5. The apparatus of claim 1 wherein said first and second shut-off partitions are swivelable about an axis which is transverse to a conveying direction of said material to be treated.

6. The apparatus of claim 1 further comprising first and second seals disposed between said lid and said first and second shut-off partitions respectively.

7. The apparatus of claim 6 further comprising elastic means connected to said first and second shut-off partitions which exert a retaining force on said first and second shut-off partitions which restrains movement of said shut-off partitions.

8. The apparatus of claim 7 wherein said first and second seals comprise said elastic means.

9. The apparatus of claim 8 wherein the elasticity of said elastic means is adjustable.

10. The apparatus of claim 1 further comprising first and second wearing stones extending between opposing sidewalls and below said first and second shut-off partitions respectively, each of said first and second wearing stones having an outlet opening therein through which said treatment liquid passes from said inner space into said inlet and outlet chambers.

11. The apparatus of claim 1 wherein said vessel further comprises a closable throttle valve through which treatment liquid which has evaporated can be discharged from said inner space.

12. The apparatus of claim 1 further comprising first and second pairs of squeezing rollers disposed within said inlet and outlet chambers respectively.

* * * * *